US011430587B2

(12) United States Patent
Hasanovic et al.

(10) Patent No.: US 11,430,587 B2
(45) Date of Patent: Aug. 30, 2022

(54) HIGH FREQUENCY SPIRAL TERMINATION

(71) Applicant: SMITHS INTERCONNECT AMERICAS, INC., Kansas City, KS (US)

(72) Inventors: Moamer Hasanovic, Palm City, FL (US); Michael J. Kettner, Stuart, FL (US); Conrad W. Jordan, Stuart, FL (US)

(73) Assignee: SMITHS INTERCONNECT AMERICAS, INC., Kansas City, KS (US)

( * ) Notice: Subject to any disclaimer, the term of this patent is extended or adjusted under 35 U.S.C. 154(b) by 330 days.

(21) Appl. No.: 16/632,842

(22) PCT Filed: Jan. 14, 2020

(86) PCT No.: PCT/US2020/013560
§ 371 (c)(1),
(2) Date: Jan. 21, 2020

(87) PCT Pub. No.: WO2020/150272
PCT Pub. Date: Jul. 23, 2020

(65) Prior Publication Data

US 2021/0202136 A1 Jul. 1, 2021

Related U.S. Application Data

(60) Provisional application No. 62/792,707, filed on Jan. 15, 2019.

(51) Int. Cl.
*H01P 1/26* (2006.01)
*H01C 1/012* (2006.01)
(Continued)

(52) U.S. Cl.
CPC ..... *H01C 1/012* (2013.01); *H01C 1/14* (2013.01); *H01C 3/18* (2013.01); *H01P 1/268* (2013.01)

(58) Field of Classification Search
CPC .... H01P 1/24; H01P 1/26; H01P 1/264; H01P 1/266; H01P 1/268; H01P 1/262;
(Continued)

(56) References Cited

U.S. PATENT DOCUMENTS 5,594,407 A * 1/1997 Caddock, Jr. ..... H01H 85/046 338/308
6,924,714 B2 * 8/2005 Jain ..... H01P 1/268 333/123
(Continued)

FOREIGN PATENT DOCUMENTS

| | | |
|---|---|---|
| CN | 1538466 | 10/2004 |
| CN | 917311 | 2/2007 |
| CN | 106410341 | 10/2018 |

OTHER PUBLICATIONS

International Preliminary Report on Patentability dated Jun. 16, 2021 in corresponding International Application No. PCT/US2020/013560 filed Jan. 14, 2020; total 5 pages.
(Continued)

*Primary Examiner* — Stephen E. Jones
(74) *Attorney, Agent, or Firm* — Snell & Wilmer LLP

(57) ABSTRACT

A high frequency termination for converting a high frequency electrical signal of a circuit into heat. The high frequency termination includes a substrate. The high frequency termination also includes a spiral resistor formed on the substrate and having a first end and a second end. The high frequency termination also includes a conductive pad electrically coupled to the first end of the spiral resistor. The high frequency termination also includes a contact electri-
(Continued)

cally coupled to the conductive pad and configured to connect to the circuit.

18 Claims, 17 Drawing Sheets

(51) Int. Cl.
*H01C 1/14* (2006.01)
*H01C 3/18* (2006.01)

(58) Field of Classification Search
CPC . H01P 1/22; H01P 1/227; H01P 1/222; H01C 1/012; H01C 1/14; H01C 3/14; H01C 3/18
USPC ..... 333/22 R
See application file for complete search history.

(56) References Cited

U.S. PATENT DOCUMENTS

| | | | | |
|---|---|---|---|---|
| 2002/0017963 | A1* | 2/2002 | Shimamoto ..... | H05K 1/0242 333/246 |
| 2003/0080725 | A1 | 5/2003 | Kodato | |
| 2005/0156686 | A1 | 7/2005 | Podell | |

OTHER PUBLICATIONS

International Search Report and Written Opinion (dated May 7, 2020) for International PCT Patent Application No. PCT/US2020/013560, filed on Jan. 14, 2020.

* cited by examiner

HIGH FREQUENCY SPIRAL TERMINATION

CROSS REFERENCE TO RELATED APPLICATIONS

This application is a 371 National Stage of International Patent Application PCT/US20/13560, entitled, "High Frequency Spiral Termination", filed Jan. 14, 2020 which claims the benefit and priority of U.S. Provisional Application Ser. No. 62/792,707, entitled "High Frequency Spiral Termination," filed on Jan. 15, 2019, the contents of which are hereby incorporated by reference in its entirety herein.

BACKGROUND

1. Field of the Invention

The present invention relates to high frequency terminations, and more particularly to high frequency terminations having a spiral resistor.

2. Description of the Related Art

Terminations are passive resistive devices conventionally used at the end of a circuit to terminate a signal to ground by converting radio frequency (RF) energy into heat. Terminations may be used at various locations in an RF circuit. Capacitance to ground is a significant issue that an RF design engineer addresses during the design of a surface mount resistive component (e.g. termination, resistor, or attenuator). Thermal management of a termination, by design, relies on a large surface area of the resistor as well as a thin substrate. The capacitance is directly proportional to the area of the resistive film in the parallel capacitor formula. As terminations grow larger to address thermal management issues associated with higher frequency electrical signals, so does the capacitive effects of the termination.

Accordingly, there is a need for a high frequency termination that counteracts these capacitive effects.

SUMMARY OF THE INVENTION

According to some embodiments, a high frequency termination for converting a high frequency electrical signal of a transmission line into heat is disclosed. The termination includes a substrate. The termination also includes a spiral resistor formed on the substrate and having a spiral shape with a first end and a second end, the spiral resistor configured to receive the high frequency electrical signal and convert the high frequency electrical signal into heat. The termination also includes a conductive pad electrically coupled to the first end of the spiral resistor and coupled to the transmission line.

Also disclosed is a system for converting a high frequency electrical signal of a transmission line into heat. The system includes a substrate. The system also includes a spiral resistor formed on the substrate and having a spiral shape with a first end and a second end, the spiral resistor configured to receive the high frequency electrical signal and convert the high frequency electrical signal into heat. The system also includes a conductive pad electrically coupled to the first end of the spiral resistor and coupled to the transmission line.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

Figure 1A:
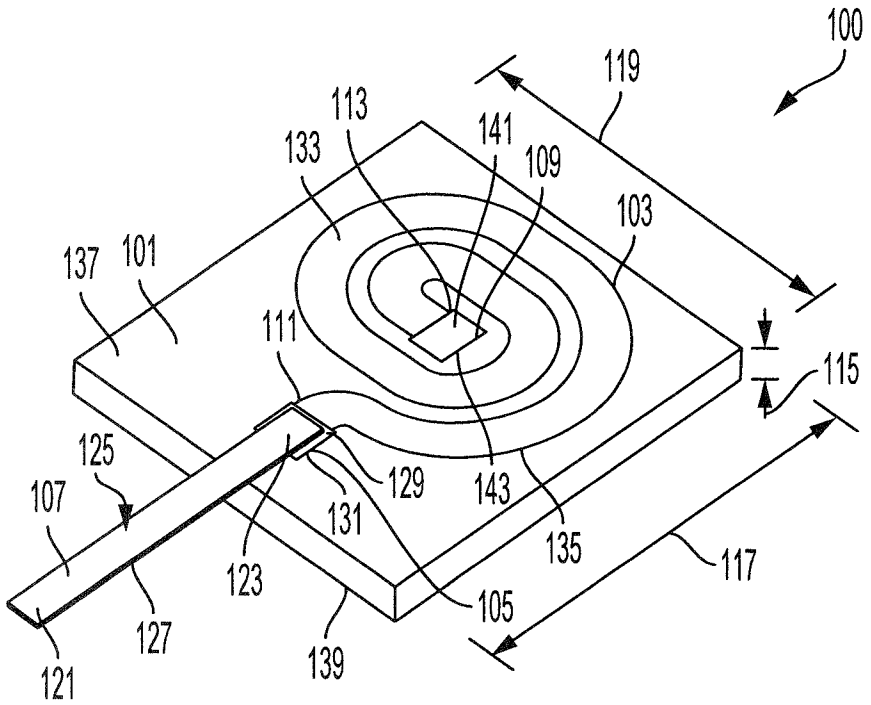
FIGS. 1A-1D show a high frequency termination, according to an embodiment of the invention.

In the following detailed description, numerous specific details are set forth to provide an understanding of the present disclosure. It will be apparent, however, to one of ordinarily skilled in the art that elements of the present disclosure may be practiced without some of these specific details. In other instances, well-known structures and techniques have not been shown in detail to avoid unnecessarily obscuring the present disclosure.

RF chip terminations are passive resistive devices used to terminate high frequency signal to ground at various locations in an RF circuit. RF chip terminations are designed to match the characteristic impedance of the transmission line and are therefore characterized by a low voltage standing wave ratio (VSWR). This in turn prevents the RF energy from being reflected back into the circuit. Terminations are generally used at the end of a circuit to terminate a signal to ground by converting radio frequency (RF) energy into heat. Thermal management of a termination, by design, relies on a large surface area of the resistor as well as a thin substrate. Larger chip and film resistor sizes increase shunt capacitance because capacitance is directly proportional to the area of the resistive film in the parallel capacitor formula. Larger capacitance makes it more difficult to tune and achieve broadband electrical performance of the device. As terminations grow larger to address thermal management issues associated with higher frequency electrical signals, so do the capacitive effects of the termination. Capacitance to ground represents one of the worst issues an RF design engineer needs to address during the design of a surface mount resistive component (e.g., termination, resistor, and attenuator). The proposed solution of a spiral geometry would balance this capacitance with an inductive effect thus enabling an opportunity to tune the RF terminations at high frequencies.

Conventional RF chip terminations may be made on a planar chip (ceramic substrate) characterized by a high thermal conductivity. A resistive film placed on the top surface of the chip is connected to the ground on the bottom surface of the chip using various process techniques. To establish this connection, the ceramic substrates of conventional RF chip terminations may contain laser drilled holes or slots. As the operational frequencies increase, the conventional RF termination chips get smaller, thus increasing the number of slots and holes over the standard "3×3" substrate used to make the chip terminations in large quantities. This significantly reduces mechanical stability of the substrates of conventional RF terminations, making them easy to break and further adding complications to screen printing, sputtering, and other processes used to fabricate these tiny RF components.

The systems and methods described herein avoid establishing the ground on the back of the chip and all the difficulties described above by relying on a long lossy transmission line with an open end. The high frequency termination, as described herein, may convert high frequency electrical signals into heat while inherently, through a spiral resistor, counteracting the capacitance to ground of the termination structure. The spiral resistor offers numerous advantages over existing resistor geometries. These advantages include a smaller termination size for a given input power or frequency, improved RF performance at higher frequencies, and distributed power dissipation over a longer lossy transmission line.

The high frequency termination, as described herein, may also allow for a simplified manufacturing process by omitting the need for using wraps or sputtering in its construction. The manufacturing process may further be simplified by omitting the connection between the resistor and ground. This may result in lower manufacturing costs and in turn lower customer costs.

Figure 1D:
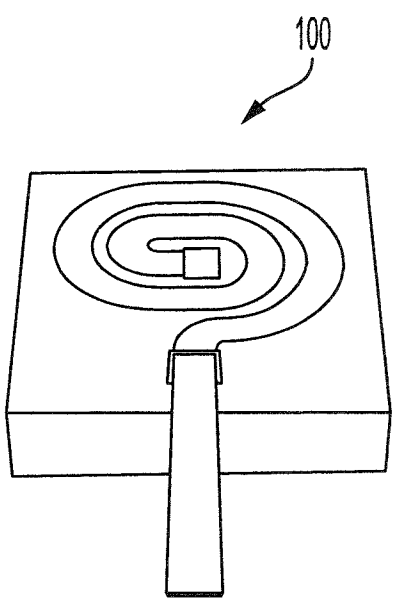
Figure 1C:
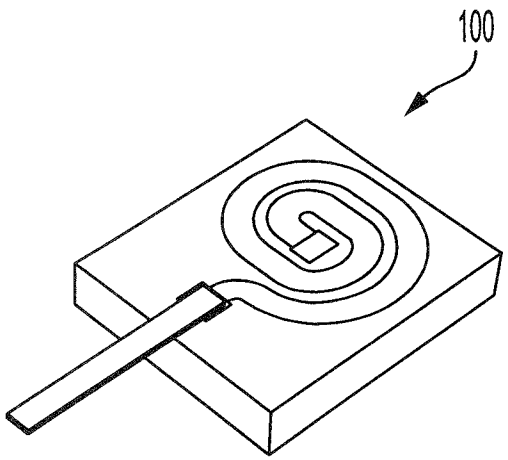
Figure 1B:
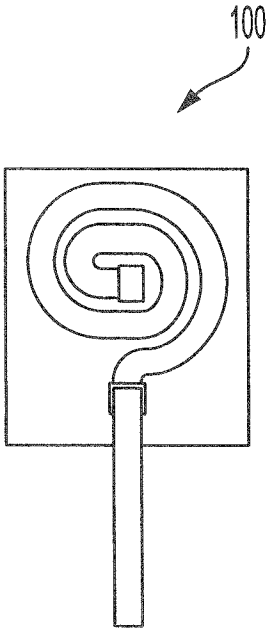

FIGS. 1A-1D show a high frequency termination 100 according to an embodiment of the invention. FIG. 1A shows an elevated perspective view of the high frequency termination 100. FIG. 1B shows a top view of the high frequency termination 100. FIG. 1C shows another elevated perspective view of the high frequency termination 100. FIG. 1D shows an elevated front view of the high frequency termination 100.

The high frequency termination 100 includes a substrate 101, a spiral resistor 103, a first conductive pad 105, a contact 107, and a second conductive pad 109.

Figure 3:
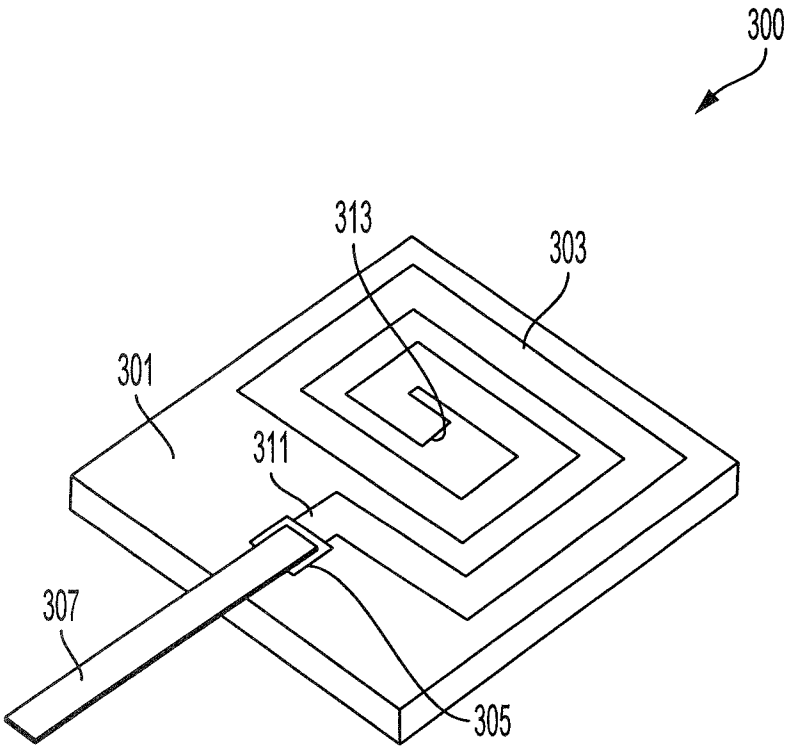
FIG. 3 shows a perspective view of a high frequency termination with a squared spiral shape, according to an embodiment of the invention.
Figure 4:
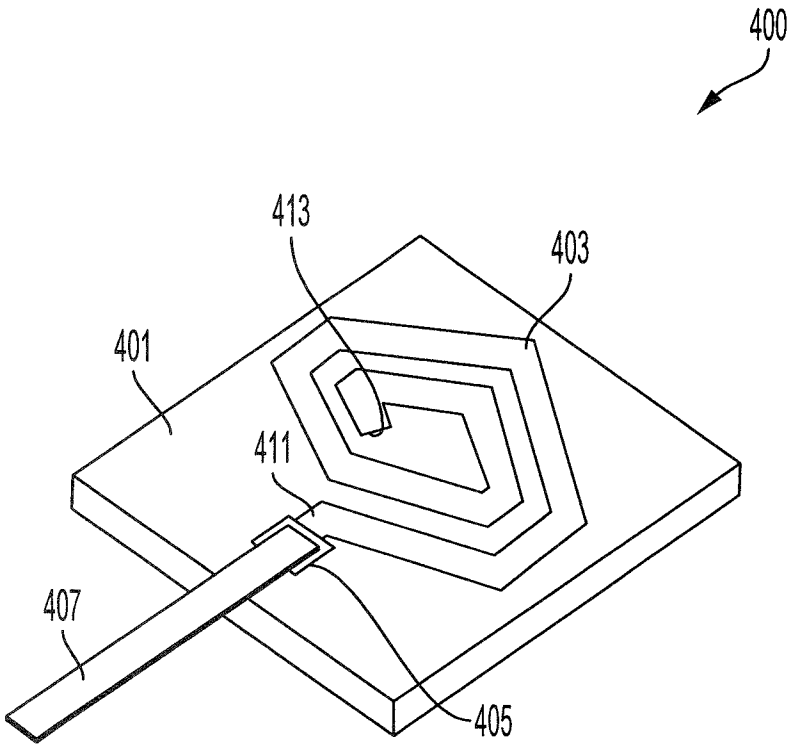
FIG. 4 shows a perspective view of a high frequency termination with a hexagonal spiral shape, according to an embodiment of the invention.

The spiral resistor 103 may be formed on the substrate 101 and may include a first end 111 and a second end 113. The spiral resistor 103 may be formed as a film on the substrate 101 according to various embodiments. The first end 111 may be electrically coupled to the first conductive pad 105 and the second end 113 may be electrically coupled to the second conductive pad 109. The spiral resistor 103 may include a plurality of turns (e.g., two full turns). As shown, the spiral resistor 103 is substantially circular. However, other geometric forms may be used interchangeably according to various embodiments. For example, the spiral resistor 103 may be substantially square shaped (as shown in FIG. 3) or substantially hexagonal shaped (as shown in FIG. 4). The spiral resistor 103 may be formed on a single plane parallel to the surface plane of the substrate 101.

The spiral resistor 103 may function as a lossy transmission line. The spiral geometry of the spiral resistor 103 may introduce an inductive effect that counteracts a capacitance to ground of the high frequency termination 100. The spiral geometry of the spiral resistor 103 may also allow for an effectively longer lossy transmission line in a comparatively smaller space without the need to terminate the spiral resistor 103 to ground. However, in some embodiments, the second conductive pad 109 may be electrically connected to ground.

In general, the higher the frequency of an electrical signal, the longer the effective length of the lossy transmission line needs to be for the electrical signal to dissipate (or "die out"). The high frequency termination 100 may convert a high frequency electrical signal of a circuit into heat. The high frequency electrical signal may enter the high frequency termination 100 via the contact 107. The high frequency electrical signal may then enter the first end 111 of the spiral resistor 103 via the first conductive pad 105. As the high frequency electrical signal travels along the length of the spiral resistor 103, its energy is gradually dissipated in the form of heat.

The heat dissipated in the spiral resistor 103 may be absorbed by the adjacent substrate 101. The energy of the high frequency electrical signal is at its greatest when it enters the first end 111 of the spiral resistor 103 and decreases as the high frequency electrical signal travels along the length of the spiral resistor 103. In some embodiments, the energy of the high frequency electrical signal may approach or reach zero when the high frequency electrical signal reaches the second end 113 of the spiral resistor 103.

Similarly, the amplitude of the high frequency electrical signal is at its greatest when the high frequency electrical signal enters the first end 111 of the spiral resistor 103 and decreases as the high frequency electrical signal travels along the length of the spiral resistor 103. Thus, the length of the spiral resistor 103 may be directly correlated or tailored to the frequency or frequency range that the spiral resistor 103 can effectively dissipate in the form of heat. In some embodiments, the amplitude of the high frequency electrical signal may approach or reach zero when the high frequency electrical signal reaches the second end 113 of the spiral resistor. The number of turns within the plurality of turns may be adjusted to increase the length of the spiral resistor 103 to address higher frequency ranges. Similarly, the number of turns within the plurality of turns may be adjusted to decrease the length of the spiral resistor 103 to address lower frequency ranges.

The substrate 101 may be made of a thermally conductive material to dissipate the heat generated by the interaction between the high frequency electrical signal and the spiral resistor 103. For example, the substrate 101 may be made of ceramic or CVD diamond. However, other thermally conductive materials may be used interchangeably according to various embodiments. The substrate 101 may have a substrate thickness 115, a substrate length 117, and a substrate width 119. The substrate thickness 115, the substrate length 117, and the substrate width 119 may be optimized and adjusted based on the application of the termination 100.

As depicted, the contact 107 is in the form of an input tab. However, other forms of contacts may be used interchangeably according to various embodiments. For example, the contact 107 may be an electrical connector or a wire bound. The contact 107 protrudes outward and extends beyond the perimeter of the substrate 101.

The contact 107 has a first (distal) end 121, and a second (proximal) end 123. The first end 121 contacts the RF circuit and the second end 123 contacts the first conductive pad 105. The contact 107 has a top surface 125 and a bottom surface 127. The contact 107 may contact the RF circuit at the top surface 125, the bottom surface 127, or the contact 107 may abut the RF circuit to connect in a non-overlapping manner. The contact 107 may contact the first conductive pad 105 at the bottom surface 127 at the second end 123 or the contact 107 may abut the first conductive pad 105 to connect in a non-overlapping manner.

The first conductive pad 105 has a top surface 129 and a bottom surface 131. The top surface 129 of the first conductive pad 105 contacts the bottom surface 127 of the contact 107 at the second end 123 of the contact 107. The bottom surface 131 of the first conductive pad 105 may contact at least a portion of the top surface 133 of the spiral resistor 103 at the first end 111 of the spiral resistor 103 or the first conductive pad 105 may abut the spiral resistor 103, connecting in a non-overlapping manner. The bottom surface 131 of the first conductive pad 105 may also partially contact the top surface 137 of the substrate 101, or may contact only the top surface 133 of the spiral resistor 103.

The spiral resistor 103 may be printed on top of the substrate 101 such that the bottom surface 135 of the spiral resistor 103 contacts the top surface 137 of the substrate 101. The second conductive pad 109 has a top surface 141 and a bottom surface 143.

In some embodiments, the bottom surface 143 of the second conductive pad 109 contacts the top surface 133 of the spiral resistor 103 at the second end 113 of the spiral resistor. In some embodiments, the bottom surface 143 of the second conductive pad 109 contacts the top surface 137 of the substrate 101 and abuts the spiral resistor 103 at the second end 113 of the spiral resistor, connecting to the spiral resistor 103 in a non-overlapping manner.

As described herein, the spiral resistor 103 may be effective when used with high frequency transmissions. A microstrip lossy transmission line having a length l may be characterized by the characteristic impedance $Z_O$ placed along z-axis and terminated with the load $Z_L$. Assuming an incident wave $V_0^+e^{-\gamma z}$ is excited at the input to this line, then the voltage and the current along the line will in general case consist of two terms corresponding to the incident and reflected wave: $V(z)=V_0^+e^{-\gamma z}+V_0^-e^{+\gamma z}$ and $$I(z) = \frac{V_0^+}{Z_0}e^{-\gamma z} - \frac{V_0^-}{Z_0}e^{+\gamma z}$$

where $\gamma=\alpha+j\beta$ represents the complex propagation constant, $\alpha$—the attenuation constant describing losses along the transmission line, and $\beta$—the propagation constant which is the function of frequency.

At the entrance to the line where z=−1, V(z) transforms into $V(l)=V_0^+e^{+\gamma l}+V_0^-e^{-\gamma l}=V_0^+e^{+\alpha l}e^{+j\beta l}+V_0^-e^{-\alpha l}e^{-j\beta l}$.

If the length of the lossy transmission line is increased, the term $e-\alpha l$ becomes small, thus effectively suppressing the reflected wave at the entrance to the line. This in turns improves the match, i.e., reduces the reflection coefficient $\Gamma$.

The input impedance of the lossy microstrip line of length l and characteristic impedance $Z_O$ is calculated as $$Z_{in} = Z_0\frac{Z_L + Z_0\tanh(\gamma l)}{Z_0 + Z_L\tanh(\gamma l)}.$$

If the transmission line is open on its other end, then this transforms into $$Z_{in} = \frac{Z_0}{\tanh(\gamma l)}.$$

A practical condition for a good match may be established as $|\Gamma|=0.1$ or 20 [dB]. In such a case, we can also derive the requirement for the input impedance, as $Z_O \le Z_{in} \le 1.224\times Z_O$ and $\tan h(\gamma l)\ge 0.82$. It can also be shown from the properties of the hyperbolic function that the shortest length of the lossy line that would meet the conditions above is for $\tan h(\gamma l_{min})=0.82$, or after a few transformations $\cos(\beta l)$ [$\sin h(\alpha l_{min})-0.82\times\cos h(\alpha l_{min})]=0$ and $\sin(\beta l)$ [$\sin h(\alpha l_{min})-0.82\times\cos h(\alpha l_{min})]=0$, which are simultaneously met if $\tan h(\gamma l)=0.82$. From the properties of the hyperbolic function $\tan h(x)$, the condition above is met for $\gamma l_{min}=1.15$ or $l\ge 1.15/\alpha$.

Attenuation in the transmission line is due to the dielectric losses and conductive losses. If $\alpha_d$ is the attenuation constant due to dielectric loss and $\alpha_d$–the attenuation constant due to the conductor loss, then the total attenuation constant can be expressed as $\alpha=\alpha_d+\alpha_c$.

The attenuation constants for a lossy microstrip transmission line can be calculated as follows $$\alpha_d = \frac{\kappa_0 + \varepsilon_r(\varepsilon_e - 1)\tan\delta}{2\sqrt{\varepsilon_e(\varepsilon_r - 1)}} \text{ and } \alpha_c = \frac{R_S}{Z_0 W}$$

where $\varepsilon_e$—the effective dielectric constant of the microstrip line, $\varepsilon_r$—the relative permeability of the microstrip substrate, tan $\delta$—the loss tangent of the microstrip substrate, W—the width of the microstrip lossy line, and $R_s$—the surface resistivity of the lossy conductor.

Assuming the dielectric losses are negligible compared to the conductor losses, the condition $l\ge 1.15/\alpha$ transforms into $$l \ge \frac{1.15 Z_0 W}{R_S}.$$

The surface resistivity $R_S$ for the lossy microstrip transmission line is given by the formula $$R_S = \sqrt{\frac{\omega\mu_0}{2\sigma}},$$

where $\omega=2\pi f$, $\mu_0=4\pi\times10^{-7}$ [H/m], and $\sigma$—conductivity of the lossy conductor. The conductivity a can be expressed as $$\sigma = \frac{t}{R_{SH}}$$

where t–thickness of the conductor and $R_{SH}$—sheet resistance (in ohms/square) of a thin film lossy transmission line on a microstrip substrate. Substituting $$\sigma = \frac{t}{R_{SH}} \text{ into } l \geq \frac{1.15Z_0W}{R_S}$$

results in $$l \geq 115Z_0W\sqrt{\frac{\sigma}{\pi f\mu_0}} = 1.15Z_0W\sqrt{\frac{t}{R_{SH}\pi f\mu_0}}.$$

Thus, that at lower frequencies, the transmission line may become too long to meet the condition $$l \geq \frac{1.15Z_0W}{R_S}.$$

Therefore, the systems and methods disclosed herein may be more effective at higher frequencies than at lower frequencies. As operational frequency goes up, the physical length of the structure decreases, thus making the systems and methods described herein more effective. At higher frequencies, as the reflection wave is significantly suppressed, it may not be necessary to terminate the lossy transmission line at the back end with a connection to ground, which significantly simplifies the production and manufacturing of the device, as materials costs and production time can both be reduced.

Figure 2:
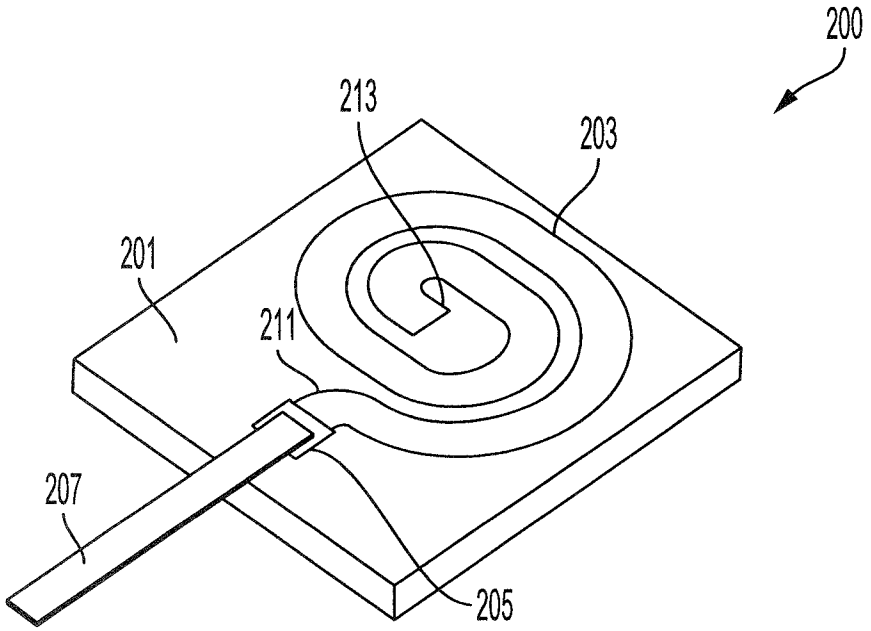
FIG. 2 shows a perspective view of a high frequency termination without a second conductive pad, according to an embodiment of the invention.

FIG. 2 shows a high frequency termination 200 according to an embodiment of the invention. The high frequency termination 200 includes a substrate 201, a spiral resistor 203, a conductive pad 205, and a contact 207. The high frequency termination 200 has components that are similar to corresponding components in high frequency termination 100 described herein, but high frequency termination 200 does not include a second conductive pad (e.g., second conductive pad 109).

The spiral resistor 203 may be formed on the substrate 201 and may include a first end 211 and a second end 213. The spiral resistor 203 may be formed as a film on the substrate 201. The first end 211 may be electrically coupled to the conductive pad 205. The spiral resistor 203 may include a plurality of turns (e.g., two full turns). As shown, the spiral resistor 203 is substantially circular. However, other geometric forms may be used interchangeably according to various embodiments. For example, the spiral resistor 203 may be substantially square shaped (as shown in FIG. 3) or substantially hexagonal shaped (as shown in FIG. 4).

The spiral resistor 203 may function as a lossy transmission line. The spiral geometry of the spiral resistor 203 may introduce an inductive effect that counteracts a capacitance to ground of the high frequency termination 200. The spiral geometry of the spiral resistor 203 may allow for an effectively longer lossy transmission line in a smaller space without the need to effectively terminate the spiral resistor 203 to ground.

In general, the higher the frequency of an electrical signal, the longer the effective length of the lossy transmission line needs to be for the electrical signal to dissipate (die out). The high frequency termination 200 may convert a high frequency electrical signal of a circuit into heat. The high frequency electrical signal may enter the high frequency termination 200 via the contact 207. The high frequency electrical signal may then enter the first end 211 of the spiral resistor 203 via the conductive pad 205. As the high frequency electrical signal travels along the length of the spiral resistor 203, its energy is gradually dissipated in the form of heat.

The heat dissipated in the spiral resistor 203 may be absorbed by the adjacent substrate 201. The energy of the high frequency electrical signal is at its greatest when the high frequency electrical signal enters the first end 211 of the spiral resistor 203 and decreases as the high frequency electrical signal travels along the length of the spiral resistor 203. In some embodiments, the energy of the high frequency electrical signal may approach or reach zero when the high frequency electrical signal reaches the second end 213 of the spiral resistor 203.

Similarly, the amplitude of the high frequency electrical signal is at its greatest when it enters the first end 211 of the spiral resistor 203 and decreases as the high frequency electrical signal travels along the length of the spiral resistor 203. Thus, the length of the spiral resistor 203 may be directly correlated or tailored to the frequency or frequency range that the spiral resistor 203 can effectively dissipate in the form of heat. In some embodiments, the amplitude of the high frequency electrical signal may approach or reach zero when the high frequency electrical signal reaches the second end 213 of the spiral resistor. The number of turns within the plurality of turns may be adjusted to increase the length of the spiral resistor 203 to address higher frequency ranges. Similarly, the number of turns within the plurality of turns may be adjusted to decrease the length of the spiral resistor 203 to address lower frequency ranges.

The substrate 201 may be made of a thermally conductive material to dissipate the heat generated by the interaction between the high frequency electrical signal and the spiral resistor 203. For example, the substrate 201 may be made of ceramic or CVD diamond. However, other thermally conductive materials may be used interchangeably according to various embodiments.

As depicted, the contact 207 is in the form of an input tab. However, other forms of contacts may be used interchangeably according to various embodiments. For example, the contact 207 may be an electrical connector or a wire bound.

FIG. 3 shows a high frequency termination 300 according to an embodiment of the invention. The high frequency termination 300 includes a substrate 301, a spiral resistor 303, a conductive pad 305, and a contact 307. The high frequency termination 300 has components that are similar to corresponding components in high frequency termination 100 described herein, but the spiral resistor 303 is substantially square shaped, whereas spiral resistor 103 and 203 are circular shaped. While high frequency termination 300 is illustrated as not including a second conductive pad (e.g., second conductive pad 109), in some embodiments, the high frequency termination 300 also includes a second conductive pad substantially similar to second conductive pad 109.

The substrate 301 may be configured similarly as substrates 101, 201 discussed in regard to FIGS. 1A-1D and 2, and may include similar features as the substrates 101, 201 discussed in regard to FIGS. 1A-1D and 2. The spiral resistor 303 may be configured similarly as spiral resistors 103, 203 discussed in regard to FIGS. 1A-1D and 2, and may include similar features as the spiral resistors 103, 203 discussed in regard to FIGS. 1A-1D and 2. The conductive pad 305 may be configured similarly as conductive pads 105, 205 discussed in regard to FIGS. 1A-1D and 2, and may include similar features as the conductive pads 105, 205 discussed in regard to FIGS. 1A-1D and 2. The contact 307 may be configured similarly as contacts 107, 207 discussed in regard to FIGS. 1A-1D and 2, and may include similar features as the contacts 107, 207 discussed in regard to FIGS. 1A-1D and 2.

FIG. 4 shows a high frequency termination 400 according to an embodiment of the invention. The high frequency termination 400 includes a substrate 401, a spiral resistor 403, a conductive pad 405, and a contact 407. The high frequency termination 400 has components that are similar to corresponding components in high frequency terminations 100, 200, and 300 described herein, but the spiral resistor 403 is substantially hexagonally shaped, whereas spiral resistor 103 and 203 are circular shaped and spiral resistor 303 is square shaped. While high frequency termination 400 is illustrated as not including a second conductive pad (e.g., second conductive pad 109), in some embodiments, the high frequency termination 400 also includes a second conductive pad substantially similar to second conductive pad 109.

The substrate 401 may be configured similarly as substrates 101, 201 discussed in regard to FIGS. 1A-1D and 2, and may include similar features as the substrates 101, 201 discussed in regard to FIGS. 1A-1D and 2. The spiral resistor 403 may be configured similarly as spiral resistors 103, 203 discussed in regard to FIGS. 1A-1D and 2, and may include similar features as the spiral resistors 103, 203 discussed in regard to FIGS. 1A-1D and 2. The conductive pad 405 may be configured similarly as conductive pads 105, 205 discussed in regard to FIGS. 1A-1D and 2, and may include similar features as the conductive pads 105, 205, discussed in regard to FIGS. 1A-1D and 2. The contact 407 may be configured similarly as contacts 107, 207 discussed in regard to FIGS. 1A-1D and 2, and may include similar features as the contacts 107, 207 discussed in regard to FIGS. 1A-1D and 2.

Figure 5A:
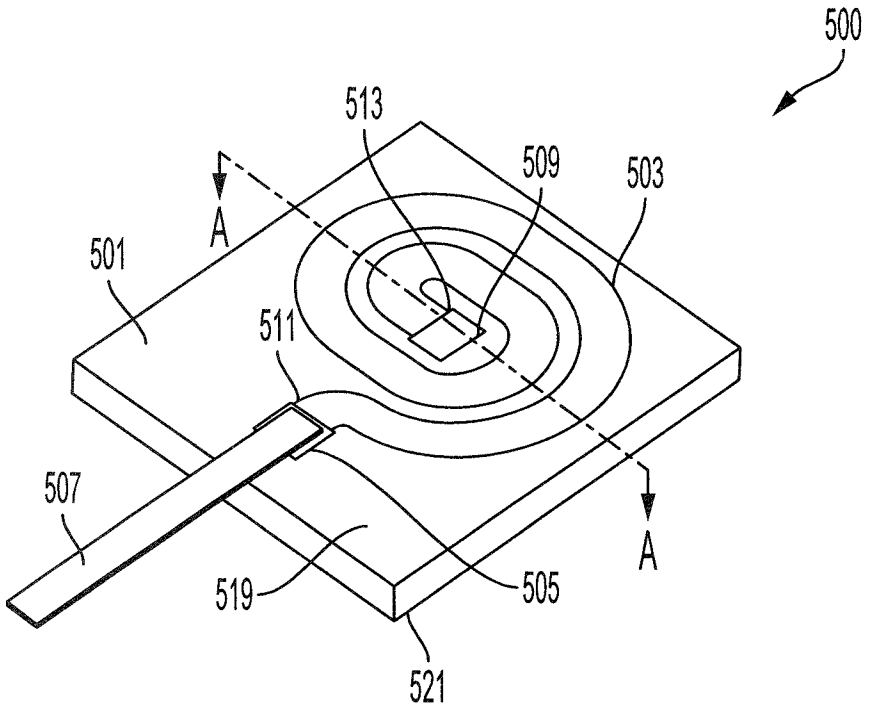
FIGS. 5A-5B show a high frequency termination, according to an embodiment of the invention.
Figure 5B:
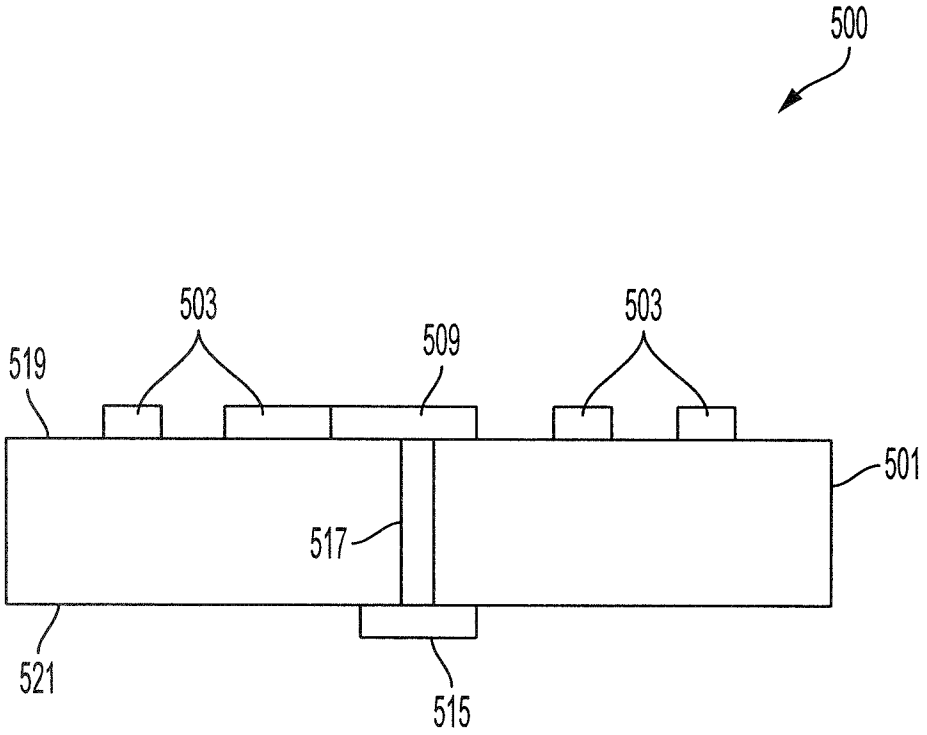

FIGS. 5A-5B show a high frequency termination 500 according to an embodiment of the invention. The high frequency termination 500 includes a substrate 501, a spiral resistor 503, a conductive pad 505, and a contact 507. In some embodiments, the high frequency termination 500 may optionally include a second conductive pad 509.

The substrate 501 may be configured similarly as substrates 101, 201 discussed in regard to FIGS. 1A-1D and 2, and may include similar features as the substrates 101, 201 discussed in regard to FIGS. 1A-1D and 2. The substrate 501 may include a first side 519 and a second side 521 opposite the first side 519. The spiral resistor 503 may be configured similarly as spiral resistors 103, 203 discussed in regard to FIGS. 1A-1D and 2, and may include similar features as the spiral resistors 103, 203 discussed in regard to FIGS. 1A-ID and 2. The conductive pad 505 may be configured similarly as conductive pads 105, 205 discussed in regard to FIGS. 1A-1D and 2, and may include similar features as the conductive pads 105, 205, discussed in regard to FIGS. 1A-1D and 2. The contact 507 may be configured similarly as contacts 107, 207 discussed in regard to FIGS. 1A-1D and 2, and may include similar features as the contacts 107, 207 discussed in regard to FIGS. 1A-1D and 2.

FIG. 5B illustrates a cross sectional view of the high frequency termination 500 along a line A-A in FIG. 5A.

As depicted, the spiral resistor 503 and the second conductive pad 509 are positioned on the first side 519 of the substrate 501. The high frequency termination 500 may include a third conductive pad 515 positioned on the second side 521 of the substrate 501. The third conductive pad 515 may be electrically connected to the second conductive pad 509 by one or more vertical interconnect accesses (VIAs) 517. In some embodiments, the third conductive pad 515 may connect the high frequency termination 500 to ground.

Figure 6A:
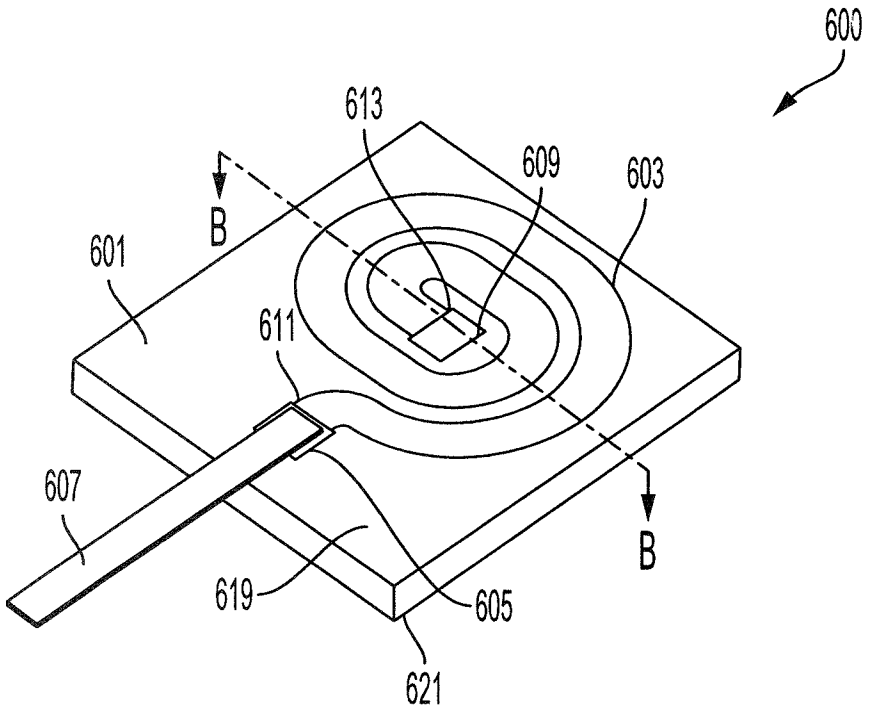
FIGS. 6A-6B show a high frequency termination, according to an embodiment of the invention.
Figure 6B:
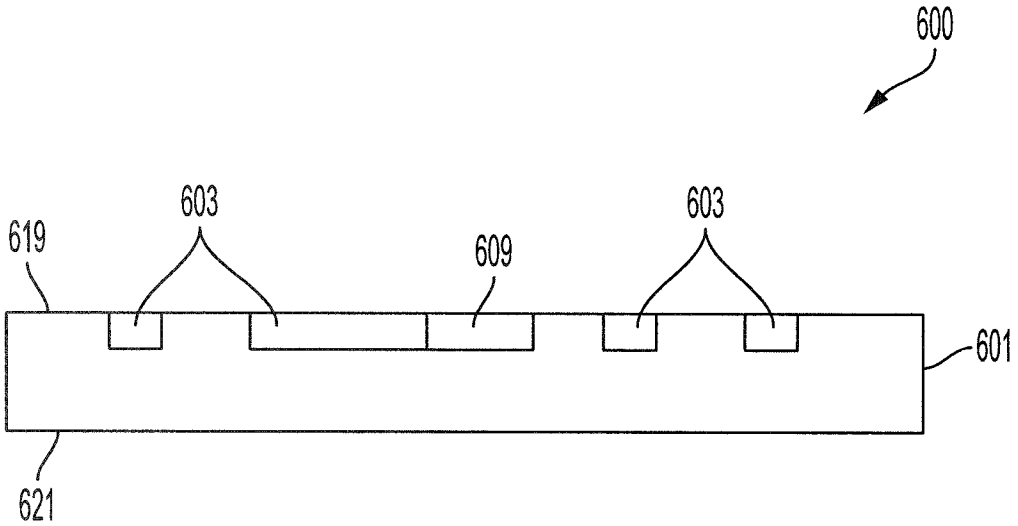

FIGS. 6A-6B show a high frequency termination 600 according to an embodiment of the invention. The high frequency termination 600 includes a substrate 601, a spiral resistor 603, a conductive pad 605, and a contact 607. In some embodiments, the high frequency termination 600 may optionally include a second conductive pad 609.

The substrate 601 may be configured similarly as substrates 101, 201 discussed in regard to FIGS. 1A-1D and 2, and may include similar features as the substrates 101, 201 discussed in regard to FIGS. 1A-1D and 2. The substrate 601 may include a first side 619 and a second side 621 opposite the first side 619. The spiral resistor 603 may be configured similarly as spiral resistors 103, 203 discussed in regard to FIGS. 1A-1D and 2, and may include similar features as the spiral resistors 103, 203 discussed in regard to FIGS. 1A-1D and 2. The conductive pad 605 may be configured similarly as conductive pads 105, 205 discussed in regard to FIGS. 1A-1D and 2, and may include similar features as the conductive pads 105, 205, discussed in regard to FIGS. 1A-1D and 2. The contact 607 may be configured similarly as contacts 107, 207 discussed in regard to FIGS. 1A-1D and 2, and may include similar features as the contacts 107, 207 discussed in regard to FIGS. 1A-1D and 2.

FIG. 6B illustrates a cross sectional view of the high frequency termination 600 along a line B-B in FIG. 6A.

As depicted, the spiral resistor 603 and the second conductive pad 609 are formed at least partially within the substrate 601 such that the spiral resistor 603 and the conductive pad 609 are at least partially surrounded by the substrate 601. In other embodiments, only the spiral resistor 603 and the conductive pad 605 may be formed at least partially within the substrate 601 such that the spiral resistor 603 and the conductive pad 605 are at least partially surrounded by the substrate 601. In some embodiments, at least one of the spiral resistor 603, the conductive pad 605, or the second conductive pad 609 may form a flush surface with the first side 619 of the substrate 601. In other embodiments, at least one of the spiral resistor 603, the conductive pad 605, or the second conductive pad 609 may protrude from the surface of first side 619 of the substrate 601.

Figure 7A:
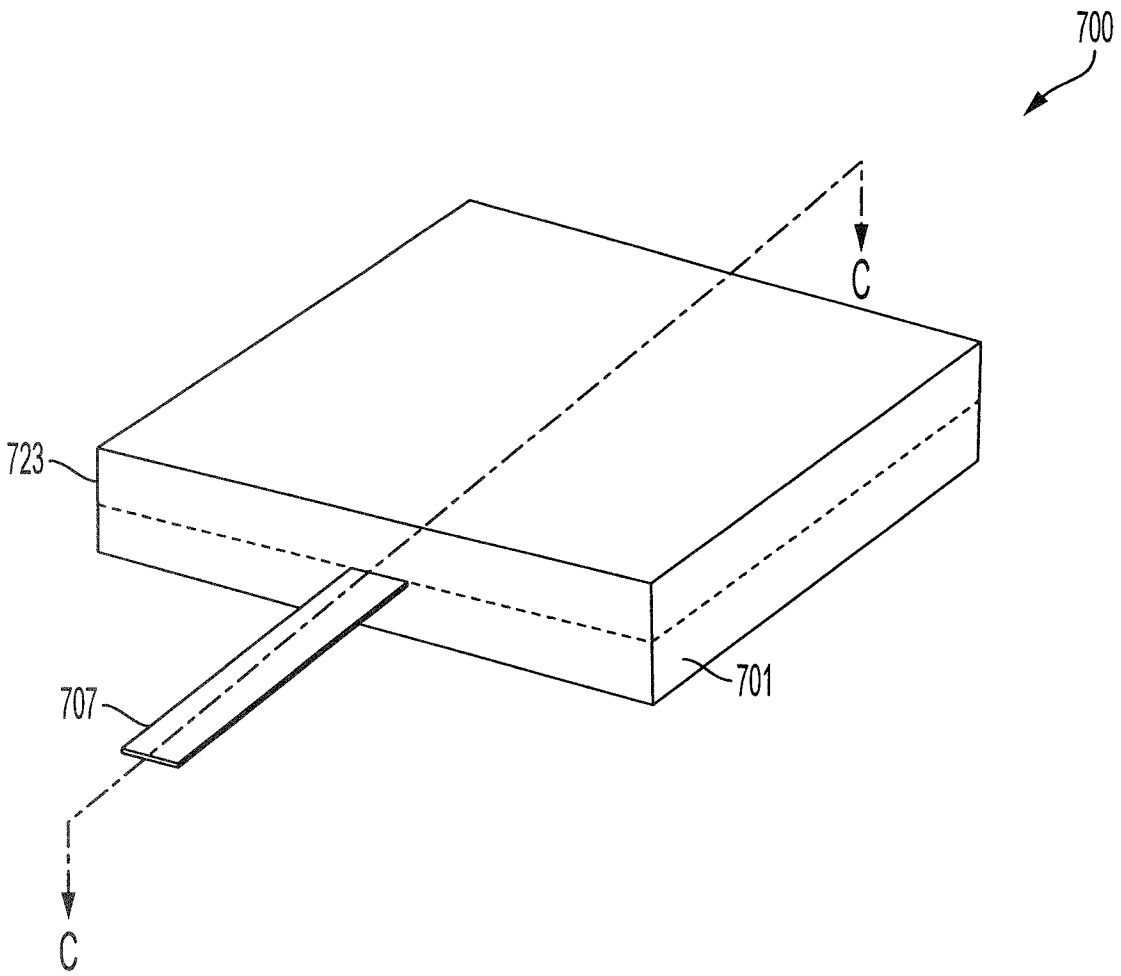
FIGS. 7A-7B show a high frequency termination, according to an embodiment of the invention.
Figure 7B:
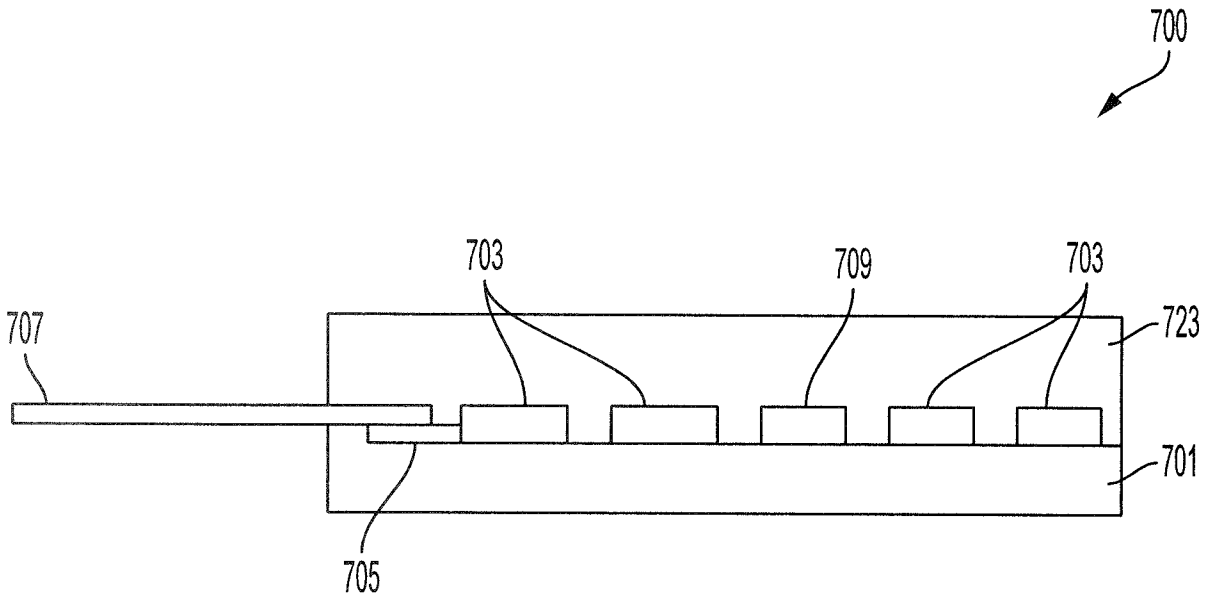

FIGS. 7A-7B show a high frequency termination 700 according to an embodiment of the invention. The high frequency termination 700 includes a first substrate 701, a spiral resistor 703, a conductive pad 705, a contact 707, and a second substrate 723. In some embodiments, the high frequency termination 700 may optionally include a second conductive pad 709.

The first substrate 701 may be configured similarly as substrates 101, 201 discussed in regard to FIGS. 1A-1D and 2, and may include similar features as the substrates 101, 201 discussed in regard to FIGS. 1A-1D and 2. The spiral resistor 703 may be configured similarly as spiral resistors 103, 203 discussed in regard to FIGS. 1A-1D and 2, and may include similar features as the spiral resistors 103, 203 discussed in regard to FIGS. 1A-1D and 2. The conductive pad 705 may be configured similarly as conductive pads 105, 205 discussed in regard to FIGS. 1A-1D and 2, and may include similar features as the conductive pads 105, 205, discussed in regard to FIGS. 1A-1D and 2. The contact 707 may be configured similarly as contacts 107, 207 discussed in regard to FIGS. 1A-1D and 2, and may include similar features as the contacts 107, 207 discussed in regard to FIGS. 1A-1D and 2.

FIG. 7B illustrates a cross sectional view of the high frequency termination 700 along a line C-C in FIG. 7A. As depicted, the spiral resistor 703, the conductive pad 705, the contact 707, and the second conductive pad 709 are covered by the second substrate 723. In some embodiments, only the spiral resistor 703 and the conductive pad 705 may be covered by the second substrate 723. In other embodiments, only the spiral resistor 703, the conductive pad 705, and a portion of the contact 707 may be covered by the second substrate 723.

Figure 8:
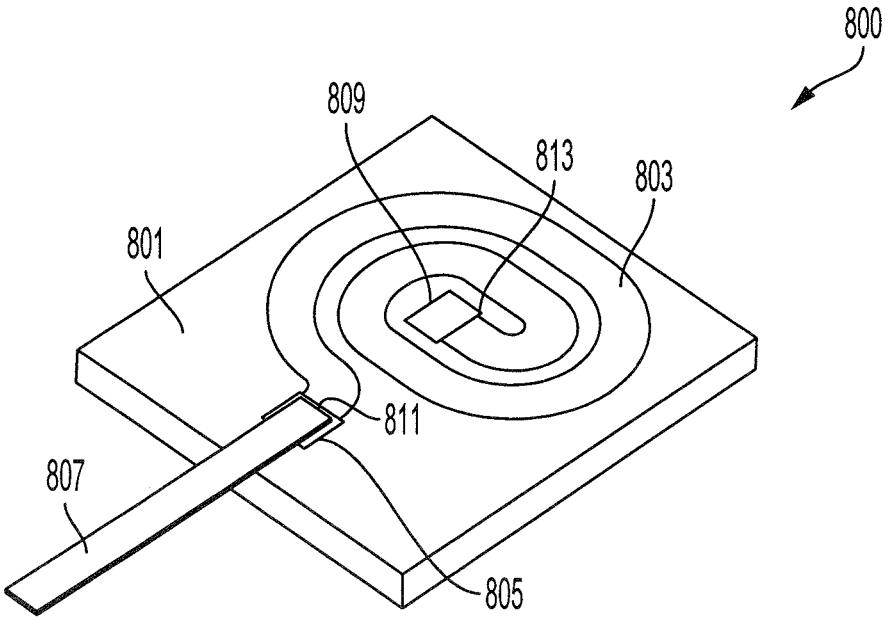
FIG. 8 shows a perspective view of a high frequency termination, according to an embodiment of the invention.

FIG. 8 shows a high frequency termination 800 according to an embodiment of the invention. The high frequency termination 800 includes a substrate 801, a spiral resistor 803, a first conductive pad 805, a contact 807, and a second conductive pad 809. The high frequency termination 800 has components that are similar to corresponding components in high frequency terminations 100, 200, 300, and 400 described herein, but the spiral resistor 803 turns in a clockwise direction from the first end 811 of the spiral resistor 803 to the second end 813 of the spiral resistor 803, whereas spiral resistor 103, 203, 303, and 403 turn in a counter-clockwise direction from the first end (e.g., first end 111) to the second end (e.g., second end 113) of the spiral resistor. While high frequency termination 800 is illustrated as including a second conductive pad 809, in some embodiments, the high frequency termination 800 does not include a second conductive pad.

The substrate 801 may be configured similarly as substrates 101, 201 discussed in regard to FIGS. 1A-1D and 2, and may include similar features as the substrates 101, 201 discussed in regard to FIGS. 1A-1D and 2. The spiral resistor 803 may be configured similarly as spiral resistors 103, 203 discussed in regard to FIGS. 1A-1D and 2, and may include similar features as the spiral resistors 103, 203 discussed in regard to FIGS. 1A-1D and 2. The first conductive pad 805 may be configured similarly as conductive pads 105, 205 discussed in regard to FIGS. 1A-1D and 2, and may include similar features as the conductive pads 105, 205, discussed in regard to FIGS. 1A-1D and 2. The contact 807 may be configured similarly as contacts 107, 207 discussed in regard to FIGS. 1A-1D and 2, and may include similar features as the contacts 107, 207 discussed in regard to FIGS. 1A-1D and 2. The second conductive pad 809 may be configured similarly as second conductive pad 109 discussed in regard to FIGS. 1A-1D, and may include similar features as the conductive pad 109, discussed in regard to FIGS. 1A-1D.

Figure 9:
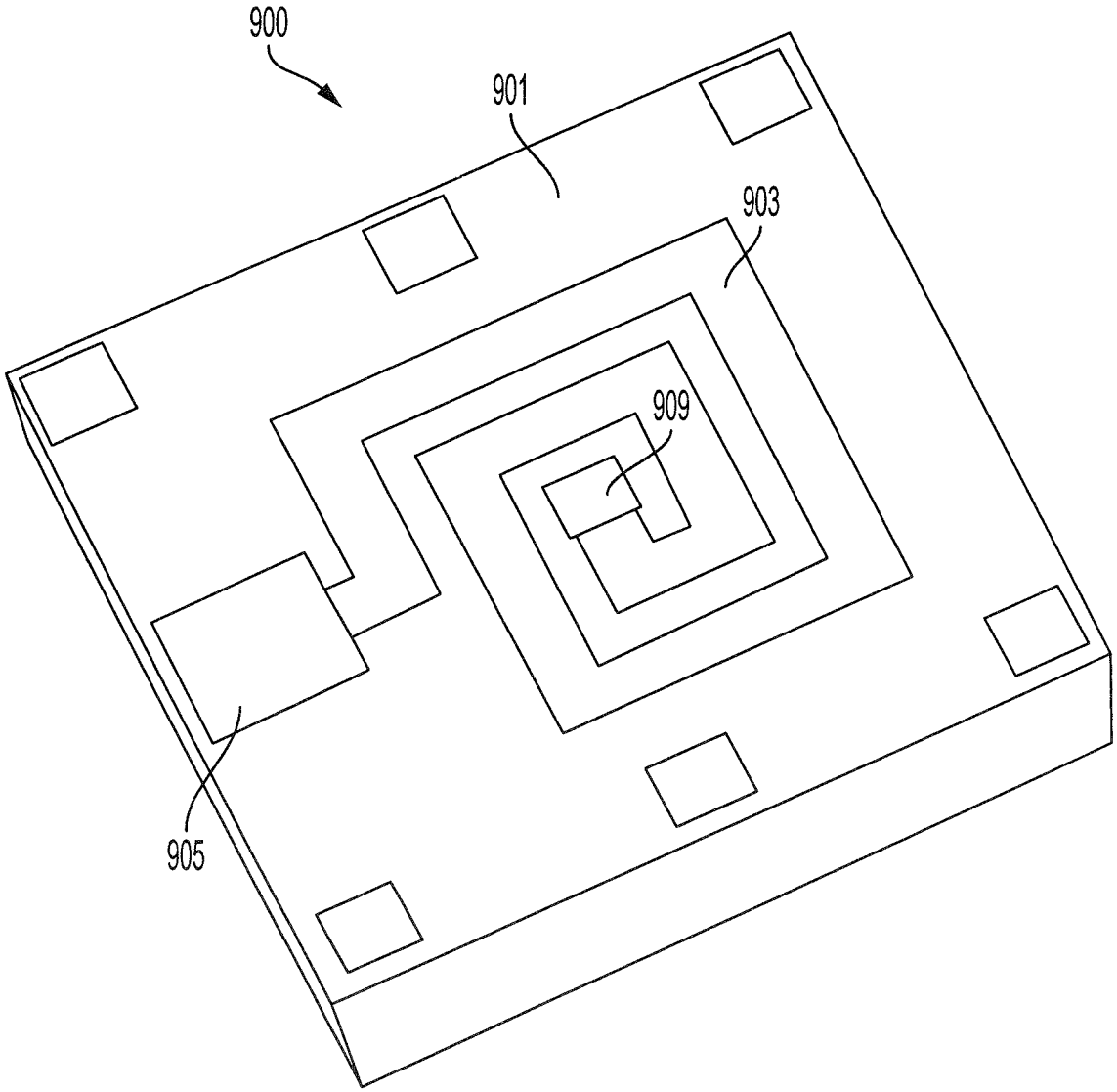
FIG. 9 shows a perspective view of a high frequency termination without a protruding contact, according to an embodiment of the invention.

FIG. 9 shows a high frequency termination 900 according to an embodiment of the invention. The high frequency termination 900 includes a substrate 901, a spiral resistor 903, a first conductive pad 905, and a second conductive pad 909. The high frequency termination 900 has components that are similar to corresponding components in high frequency terminations 100, 200, 300, and 400 described herein, but the high frequency termination 900 does not include a protruding contact (e.g., contact 107), and instead, the first conductive pad 905 serves as a contact. While high frequency termination 900 is illustrated as including a second conductive pad 909, in some embodiments, the high frequency termination 900 does not include a second conductive pad.

The substrate 901 may be configured similarly as substrates 101, 201 discussed in regard to FIGS. 1A-1D and 2, and may include similar features as the substrates 101, 201 discussed in regard to FIGS. 1A-1D and 2. The spiral resistor 903 may be configured similarly as spiral resistors 103, 203 discussed in regard to FIGS. 1A-1D and 2, and may include similar features as the spiral resistors 103, 203 discussed in regard to FIGS. 1A-1D and 2. The first conductive pad 905 may be configured similarly as conductive pads 105, 205 discussed in regard to FIGS. 1A-1D and 2, and may include similar features as the conductive pads 105, 205, discussed in regard to FIGS. 1A-1D and 2. The second conductive pad 909 may be configured similarly as second conductive pad 109 discussed in regard to FIGS. 1A-ID, and may include similar features as the conductive pad 109, discussed in regard to FIGS. 1A-1D.

As high frequency termination 900 lacks a protruding contact (e.g., contact 107, 207, 307, 407), the high frequency termination 900 may be mounted directly on top of a transmission line, as will be further illustrated herein.

Simulation and testing were performed on embodiments of the systems and methods described herein. The spiral resistor was printed on an Alumina ($Al_2O_3$) substrate with thickness 0.127 [mm]. To achieve a characteristic impedance of 50[Ω], the line (e.g., spiral resistor) should be approximately 0.125 [mm] wide. The sheet resistance of the line is 1 Ω/square and the line thickness is 0.00254 [mm]. Using the equations described herein, the minimum frequency for which the open lossy microstrip line (e.g., spiral resistor) of $l_0$ realized on Alumina substrate with thickness 0.127 [mm] will provide a good match with the return loss of −30 [dB] is $$f_{min}[\text{GHz}] = \frac{5,317}{(l_0[\text{mm}])^2}.$$

Figure 10:
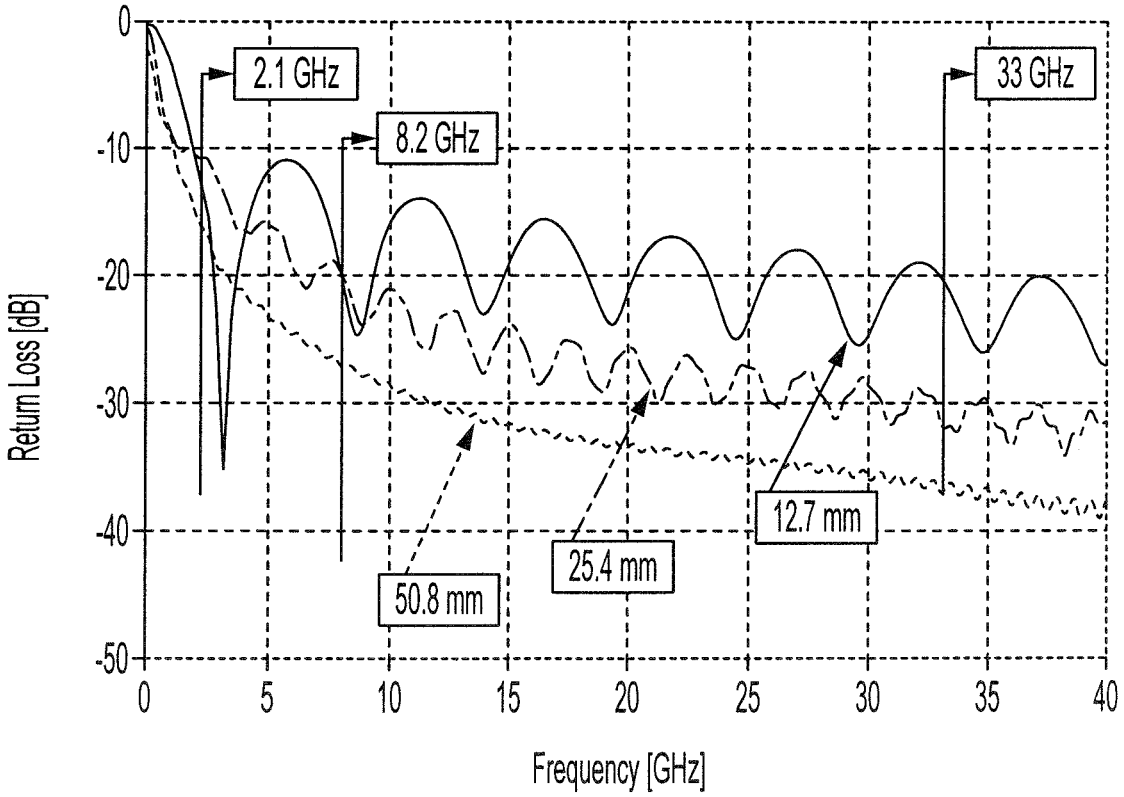
FIG. 10 shows electrical performance of a high frequency termination, according to an embodiment of the invention.

To prove the this, open lossy lines of three different lengths (12.7 [mm], 25.4 [mm], and 50.8 [mm]) were designed and evaluated. The corresponding minimum frequencies for these lines at which return loss of −20 [dB] is achievable are 33 [GHz], 8.2 [GHz], and 2.1 [GHz], respectively. FIG. 10 shows the electrical performance of these three lines; good correlation is achieved.

To provide for a more compact design, the open lossy transmission lines (e.g., spiral resistors) were wound into spiral geometries of both square shape and round shape. Spiral geometries also add extra inductance that was used in conjunction with the excessive shunt capacitance due to the relatively thin substrate. This way a distributed lossy L-C structure was created to provide for a more even dissipation of the power across the entire surface of the chip.

Figure 11A:
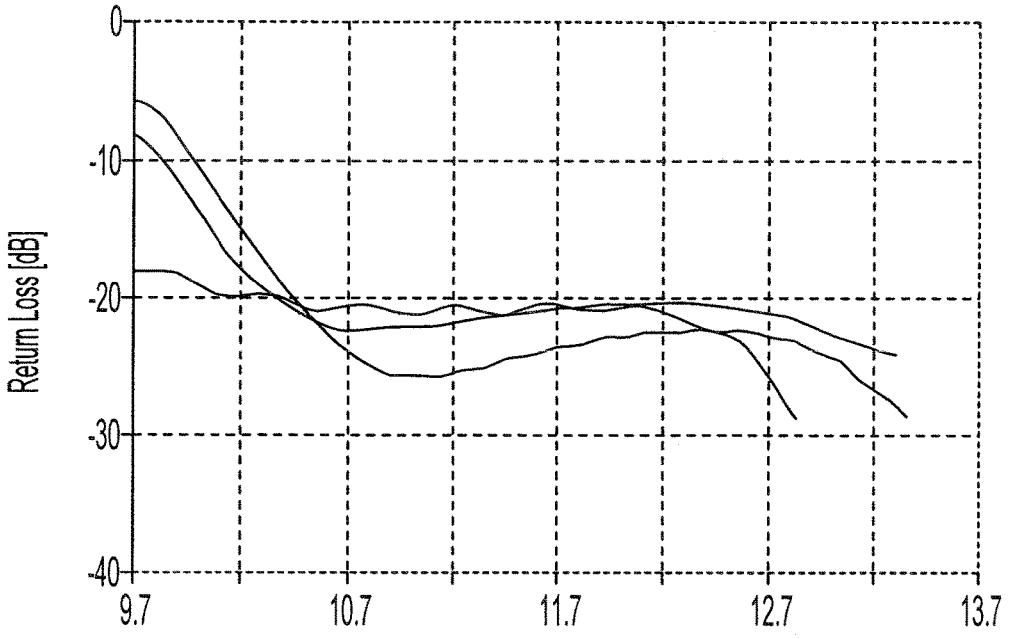
FIG. 11A shows electrical performance of a tested high frequency termination, according to an embodiment of the invention.

The proposed concept was utilized in the practical design of spiral RF termination at X-band frequencies. The lossy transmission line was printed on the beryllia (BeO) substrate using thick film screen printing process. A small conductive pad was added to the back of the line so that the resistance value of this long resistor can be checked. The length of the line was adjusted to provide matching at frequencies above 11 GHz. FIG. 11A shows the test data taken on three samples of the developed termination similar in design and components to FIG. 1A. Good electrical performance is observed at frequencies above 10.5 GHz.

Figure 11B:
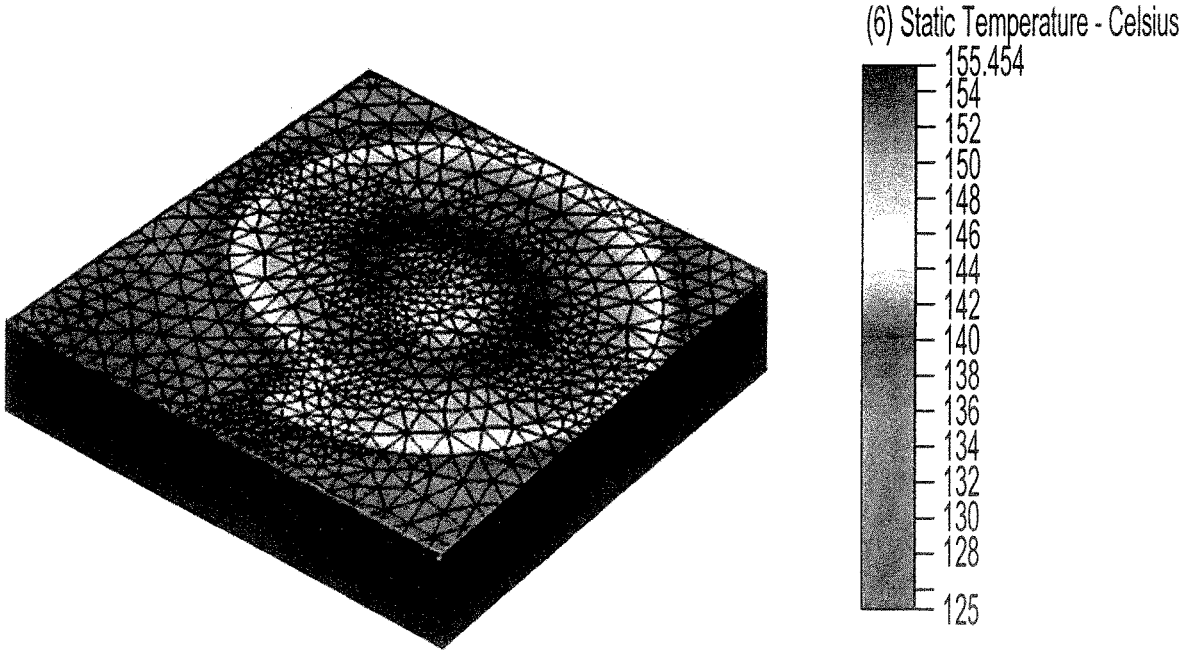
FIG. 11B shows thermal performance of a tested high frequency termination, according to an embodiment of the invention.

A thermal analysis was performed on the design using CST MPHYSICS® STUDIO. The baseplate temperature of 120° C. was applied to the bottom side of the chip with the maximum input power of 250 W at 12 GHz at the input of the structure. Electrical losses consisted of conductor losses originating from surface currents and volume dielectric losses originating from electric fields. Most of loss occurs in the lossy film of the resistor as expected while losses in other structures are negligible. All electrical losses obtained from RF simulation were exported into the thermal modeler and used to properly simulate thermal flow through the structure. The results, shown in FIG. 11B, indicated a temperature on the resistive film equal to 155.4° C. The maximum safe allowable film temperature is 160° C. so this was acceptable.

Figure 12A:
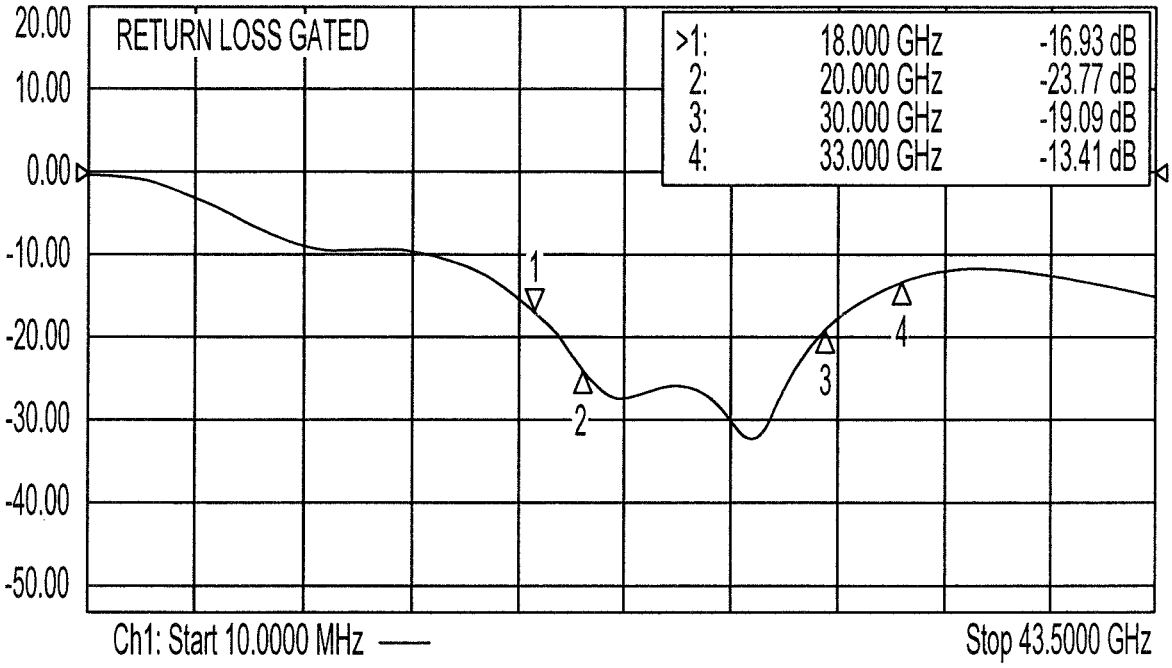
FIG. 12A shows electrical performance of a tested high frequency termination, according to an embodiment of the invention.
Figure 12B:
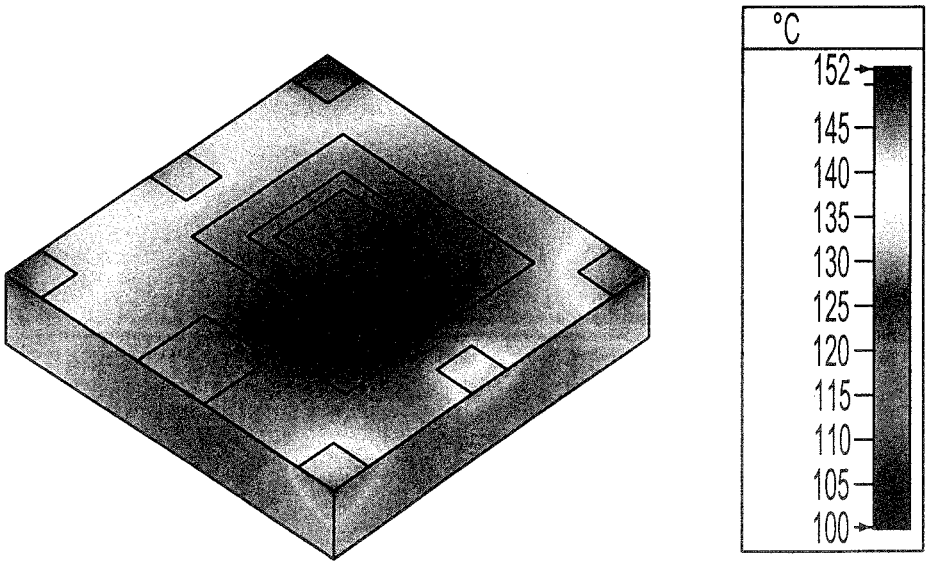
FIG. 12B shows thermal performance of a tested high frequency termination, according to an embodiment of the invention.

A similar test was performed using a high frequency termination that does not include a protruding contact (e.g., high frequency termination 900). The frequency was 20-30 GHz, the return loss was −20 [dB], the input power was 10 W CW, and the size was 1.78 [mm]×1.78 [mm]×0.38 [mm]. The electrical performance is shown in FIG. 12A and the thermal performance is shown in FIG. 12B.

Figure 13:
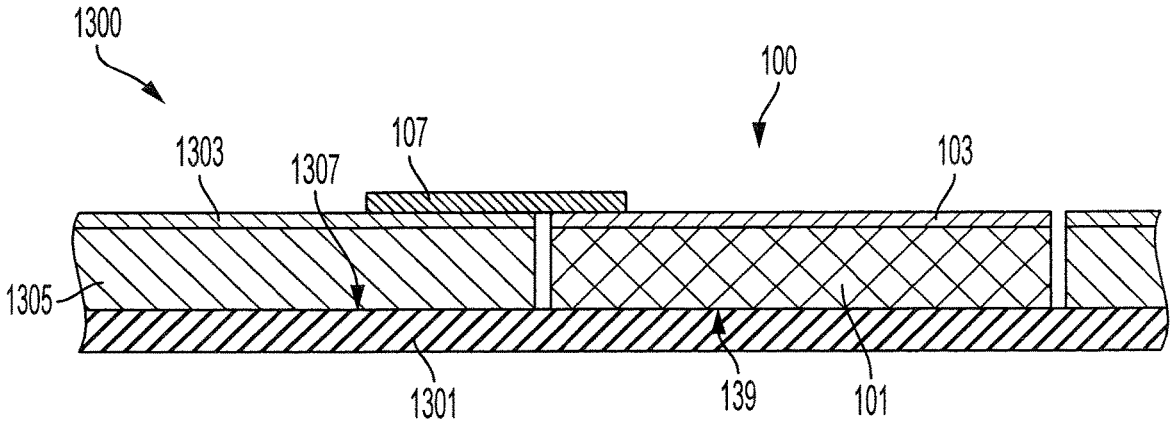
FIG. 13 shows a side cross-sectional view of a high frequency termination, according to an embodiment of the invention.

FIG. 13 illustrates a side cross-sectional view of a system 1300 in which the high frequency termination 100 may be used. The spiral resistor 103 is simplified and depicted as a layer on top of the substrate 101, but is similar to any of the spiral resistors described herein. While high frequency termination 100 is shown in FIG. 13, any of the high frequency terminations 200, 300, 400, 800 may be used in the system 1300.

The contact 107 of the high frequency termination 100 connects the spiral resistor 103 to the transmission line 1303. The transmission line 1303 is located on an application board 1305. The application board 1305 and the substrate 101 are located on top of a heatsink 1301, which absorbs heat. The RF signal received by the spiral resistor 103 and converted to heat is absorbed by the substrate 101 and transferred to the heatsink 1301 for further heat absorption. The top surface 1307 of the heatsink 1301 contacts the bottom surface 139 of the substrate 101.

The high frequency termination 100 is substantially flush with the application board 1305 and the transmission line 1303, as shown in FIG. 13, with only the contact 107 elevated and protruding vertically outward. The high frequency termination 100 may be located within a cavity defined by the application board 1305 or may be located adjacent to the end of the application board 1305.

Figure 14:
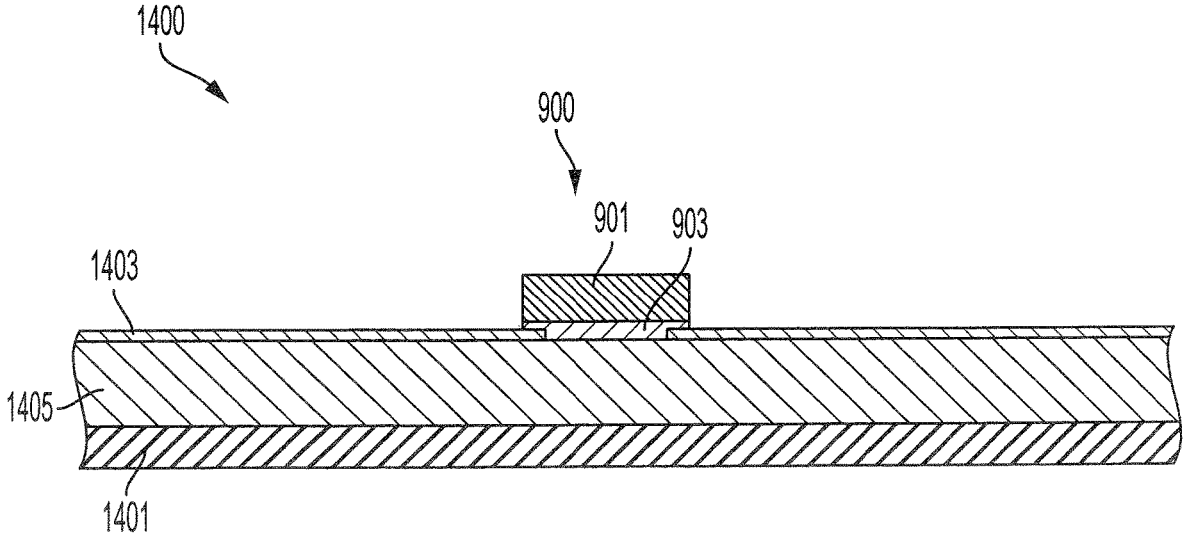
FIG. 14 shows a side cross-sectional view of a high frequency termination without a protruding contact, according to an embodiment of the invention.

FIG. 14 illustrates a side cross-sectional view of a system 1400 in which the high frequency termination 900 may be used. The spiral resistor 903 is simplified and depicted as a layer on top of the substrate 901, but is similar to any of the spiral resistors described herein.

The first conductive pad (e.g., first conductive pad 905) of the high frequency termination 900 connects the spiral resistor 903 to the transmission line 1403. The transmission line 1403 is located on an application board 1405. The high frequency termination 900 is located on top of the application board 1405 and protrudes vertically outward. The application board 1405 is located on top of a heatsink 1401, which absorbs heat. The RF signal received by the spiral resistor 903 and converted to heat is absorbed by the substrate 101 and dissipated to the atmospheric air for further heat absorption.

While the high frequency termination of system 1400 protrudes vertically outward more than the high frequency termination of system 1300, the high frequency termination 900 may be cheaper and faster to manufacture, as it does not have a contact (e.g., contact 107), and the high frequency termination 900 may be more easily retrofitted onto existing application boards 1405, as it does not require a cavity to be placed into.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A high frequency termination for converting a high frequency electrical signal of a transmission line into heat, the high frequency termination comprising:

a substrate;

a spiral resistor formed on the substrate and having a spiral shape with a first end and a second end, the spiral resistor configured to receive the high frequency electrical signal and convert the high frequency electrical signal into heat; and a conductive pad electrically coupled to the first end of the spiral resistor and coupled to the transmission line;

wherein the high frequency electrical signal enters the spiral resistor at the first end of the spiral resistor, reflects at the second end of the spiral resistor to form a reflected wave travelling toward the first end of the spiral resistor, and wherein the spiral resistor is configured to facilitate destruction of the reflected wave, obviating connection to a ground at the second end of the spiral resistor.

2. The high frequency termination of claim 1, further comprising a contact configured to electrically couple the conductive pad to the transmission line.

3. The high frequency termination of claim 2, wherein the contact is an input tab protruding beyond a perimeter of the substrate.

4. The high frequency termination of claim 2, wherein the contact is an electrical connector.

5. The high frequency termination of claim 1, further comprising a second conductive pad electrically coupled to the second end of the spiral resistor.

6. The high frequency termination of claim 1, wherein the spiral resistor is formed at least partially within the substrate such that the spiral resistor is at least partially surrounded by the substrate.

7. The high frequency termination of claim 1, wherein the spiral resistor is formed at least partially on top of the substrate.

8. The high frequency termination of claim 1, wherein the substrate, the spiral resistor, and the conductive pad are covered by a second substrate.

9. The high frequency termination of claim 1, wherein the spiral resistor comprises a plurality of turns.

10. The high frequency termination of claim 1, wherein the spiral resistor is substantially circular shaped.

11. The high frequency termination of claim 1, wherein the spiral resistor is substantially square shaped.

12. A system for converting a high frequency electrical signal of a transmission line into heat, the system comprising:

a substrate;

a spiral resistor formed on the substrate and having a spiral shape with a first end and a second end, the spiral resistor configured to receive the high frequency electrical signal and convert the high frequency electrical signal into heat; and a conductive pad electrically coupled to the first end of the spiral resistor and coupled to the transmission line;

wherein the high frequency electrical signal enters the spiral resistor at the first end of the spiral resistor, reflects at the second end of the spiral resistor to form a reflected wave travelling toward the first end of the spiral resistor, and wherein the spiral resistor is configured to facilitate destruction of the reflected wave, obviating connection to a ground at the second end of the spiral resistor.

13. The system of claim 12, further comprising a contact configured to electrically couple the conductive pad to the transmission line.

14. The system of claim 12, further comprising a second conductive pad electrically coupled to the second end of the spiral resistor.

15. The system of claim 12, wherein the substrate, the spiral resistor, and the conductive pad are covered by a second substrate.

16. The system of claim 12, wherein the spiral resistor comprises a plurality of turns.

17. The system of claim 12, wherein the spiral resistor is substantially circular shaped.

18. The system of claim 12, wherein the spiral resistor is substantially square shaped.

* * * * *